US005113223A

United States Patent [19]

Theodoulou et al.

[11] Patent Number: 5,113,223

[45] Date of Patent: May 12, 1992

[54] PRINTER FLASH FUSING SYSTEM

[75] Inventors: Sotos M. Theodoulou, Bramalea; Duncan Gibbons, Rexdale; Christopher W. Thomson, Etobicoke; Hassan A. Khataan, Mississauga, all of Canada

[73] Assignee: Delphax Systems, Canton, Mass. ; a partnership

[21] Appl. No.: 533,483

[22] Filed: Jun. 5, 1990

[51] Int. Cl.[5] ..... H05B 1/00; H05B 3/00; H05B 11/00; G03G 15/20

[52] U.S. Cl. ..... 219/220; 219/216; 355/285; 355/288

[58] Field of Search ..... 355/288, 282, 285, 286, 355/215; 219/216, 388, 220

[56] References Cited

U.S. PATENT DOCUMENTS

| | | | |
|---|---|---|---|
| 3,371,761 | 3/1975 | Mabrouk | 355/288 |
| 3,765,828 | 10/1973 | Lux | 432/233 |
| 3,953,709 | 4/1976 | Elter | 219/216 |
| 4,001,622 | 1/1977 | Howell | 313/113 |
| 4,121,888 | 10/1978 | Tomura et al. | 355/288 |
| 4,202,618 | 5/1980 | Waschk et al. . | |
| 4,205,220 | 5/1980 | O'Brien | 219/216 |
| 4,386,840 | 6/1983 | Garthwaite et al. | 355/288 |
| 4,434,353 | 2/1984 | Marsh et al. | 219/216 |
| 4,444,487 | 4/1984 | Miller et al. | 355/288 |
| 4,668,073 | 5/1987 | Hatabe et al. . | |
| 4,719,493 | 1/1988 | Maiorano . | |
| 4,766,288 | 8/1988 | Berkes et al. | 219/216 |
| 4,782,362 | 11/1988 | Mitsuya et al. | 355/288 |
| 4,821,052 | 4/1989 | Mitsuya et al. | 355/288 |
| 4,928,147 | 5/1990 | Baumann et al. | 355/288 |

*Primary Examiner*—Arthur T. Grimley
*Assistant Examiner*—Sandra L. Hoffman
*Attorney, Agent, or Firm*—Lahive & Cockfield

[57] ABSTRACT

The flash units are housed in reflector assemblies and actuated in a sequence that entirely exposes both sides of the sheet while drawing a constant amount of electrical power. Constructions of the reflector include an extruded housing, snap-in replaceable reflector surfaces, and a manifold structure that achieves cooling, fume scavenging and paper flattening. In one embodiment a two-sided sheet moves past a pair of oppositely directed flash units which are powered by a single power supply. A specularly reflective surface provides a level of reflected illumination which complements the light received directly from the flash tube to provide a constant level of illumination and fuse a toned image.

28 Claims, 9 Drawing Sheets

EVENT SEQUENCE FOR DUPLEX FUSER
| TRIGGER PULSE | LEADING EDGE POSITION | FLASH | SPEED |
|---|---|---|---|
| $t_1$ | $t_1$ | BOTTOM | NORMAL |
| $t_2$ | $t_1 + W$ | BOTTOM | NORMAL |
| $t_3$ | $t_1 + 2W$ | BOTTOM | HALF SPEED |
| $t_4$ | $t_1 + 2.5W$ | TOP | HALF SPEED |
| $t_5$ | $t_1 + 3W$ | BOTTOM | HALF SPEED |
| $t_6$ | $t_1 + 3.5W$ | TOP | HALF SPEED |
| $t_7$ | $t_1 + 4W$ | BOTTOM | HALF SPEED |
| $t_8$ | $t_1 + 4.5W$ | TOP | NORMAL |
| $t_9$ | $t_1 + 5.5W$ | TOP | NORMAL |
| $t_{10}$ | $t_1 + 6.5W$ | TOP | NORMAL OR HIGHER |
FIG. 5
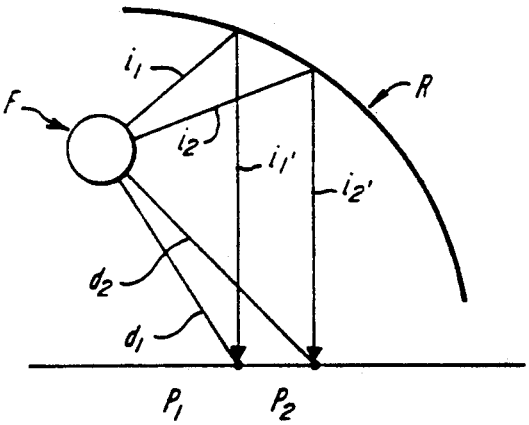
FIG. 6A
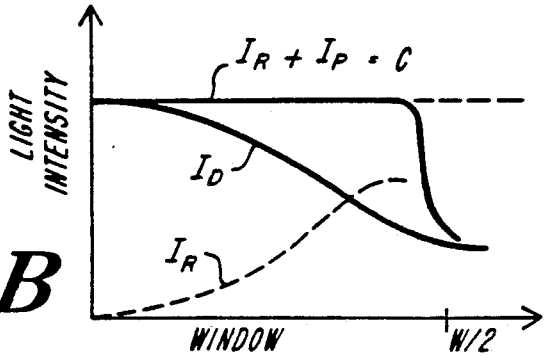
FIG. 6B

PRINTER FLASH FUSING SYSTEM

BACKGROUND OF THE INVENTION

The present invention relates to flash fusing assemblies which are used to provide a pulse of radiant energy for fusing a toned or printed image on a recording member. In such an assembly, one or more flash tubes located in a reflective housing assembly are fired to create a short duration intense light pulse, and the housing assembly operates to smooth the spatial distribution of the light while redirecting the light such that most light strikes the recorded image.

Such flash fusers offer the primary advantage of requiring power only when they are actively operated to fuse an image, thus eliminating the large power requirements of continuous or semi-continuous standby heaters, hot rolls, and radiant heaters of other constructions. On the other hand, to reap the full benefit of this power savings, the flash power must lie in a narrow power range and be uniformly directed at the image area; it preferably is applied in such a time/dose way as to fuse the toner without transferring excessive energy to the underlying paper sheet or other recording member.

The power-saving ability to operate intermittently is of primary value for low-volume imaging machines, and accordingly there is also a trade-off between the cost of electrical circuit components of sufficient capacity to fire the flash tube at an acceptable power level and flash rate, and the attainable fusing speed in pages per minute. Further, the peak power requirements may be quite large, since the power for each flash is drawn from the power lines immediately before the flash is triggered and there is no inexpensive or easy way to accumulate the energy for multiple flashes at a lower rate of power consumption.

These cost, power draw and efficiency considerations have an especially complex interdependence when it is desired to employ a flash fuser for two-sided copier or to employ multiple overlapping flashes to cover a whole sheet, or when it is desired to produce an efficient fuser which operates both for intermittent and for relatively fast or continuous paper feeds.

To address one or more of these problems, various constructions are known in the art. For example, to direct flash tube light uniformly over an image fusing window it is common to place the flash tube in front of a diffusely reflective curved reflector known as an integrating reflector. The number of reflections of any ray not directly aimed at the toned image is both large and random, so that substantial uniformity of illumination is obtained. It is also known to provide an effective flash combination at relatively slow speed with few circuit elements by providing a single power supply which alternately energizes each of a pair of adjacent flash assemblies, as shown in U.S. Pat. No. 4,386,840. While these steps each contribute to the efficiency of flash design for a particular or limited type of machine, the complicated trade-offs between efficiency, cost, speed and complexity remain, and other improvements are desirable in this area.

SUMMARY OF THE INVENTION

In accordance with the present invention a flash fusing assembly includes a flash tube positioned over an exposure window for uniformly exposing and fusing a toned image on a recording member passing by the window.

According to one aspect of the invention, a pair of flash assemblies are placed in offset positions along the direction of travel and on opposite sides of a recording web or sheet. A single flash power supply actuates different ones of the flash assemblies in an order which entirely exposes both sides of the sheet yet minimizes the peak power consumption. Preferably, this aspect includes a transport mechanism which operates at different speeds at different positions along the recording sheet path, and the sheets travel directly from the toning assembly through the fuser assembly without an intermediate backup or storage station. This is implemented in a printer wherein a single print engine prints each side of a sheet, and the sheet transport slows to half speed as the two-sided sheet passes between the opposed and offset flash fusers.

According to another aspect of the invention, the flash tube is positioned in a linearly extending housing with air inlets and outlets arranged to provide a flow of air which cools the flash tube, flattens the recording sheet in the exposure window area, and also scavenges toner fumes from the surface of the sheet along a flow path that prevents clouding of the tube and reflector and makes the fumes available for filtering in a convenient airflow stream.

According to another aspect of the invention, a curved reflector captures the indirect flash illumination from the flash tube and specularly reflects it at the window. The contour of the reflector is such that, at the exposure window, the intensity of specularly reflected indirect illumination complements that of the unreflected direct illumination from the tube and produces a substantially uniform level of illumination.

According to yet another aspect of the invention a longitudinally-extending housing for the flash assembly is formed to hold reflectors which are constituted by flexible metal sheets. The sheets are removable and replaceable by sliding along parallel supporting sills formed in the housing. Preferably the housing is an extruded form, constituting a manifold with plural air passages extending within the housing that define cooling and fume scavenging airflows about the flash tube and reflectors.

BRIEF DESCRIPTION OF DRAWINGS

These and other features of the invention will be understood by reference to the following description of illustrative embodiments taken together with the drawings, wherein:

FIG. 5 is a diagram of timing and sheet position for flash actuation of a one-fifth page width reflector cavity as in the embodiment of FIG. 4;

FIG. 6A, 6B illustrate direct and reflected flash illumination;

DETAILED DESCRIPTION OF THE INVENTION

Figure 1:
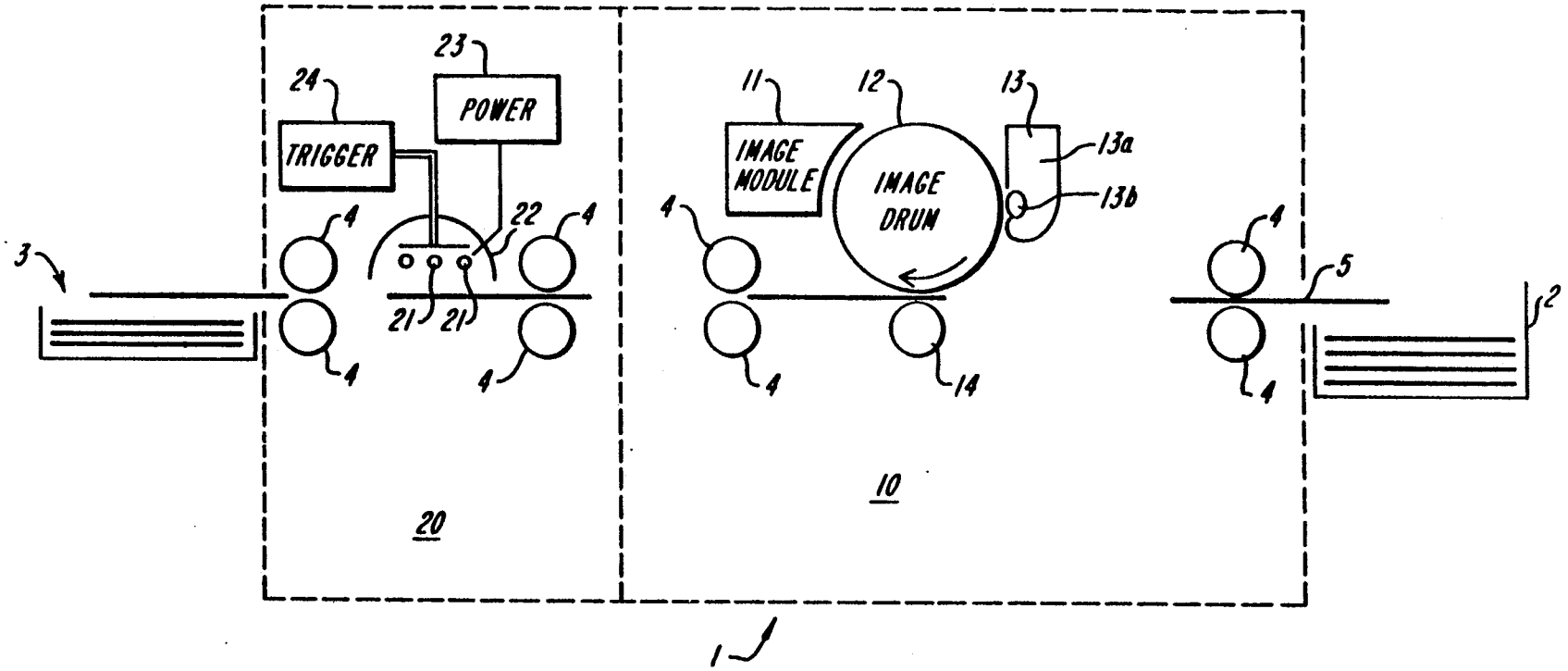
FIG. 1 shows a prior art flash fusing assembly.

FIG. 1 illustrates a flash fuser in a general prior art printing or copying apparatus 1, in which blank roll or sheet paper is fed from a supply 2 and receives images thereon to form finished prints which are transported to output bin 3. A series of belts or other transport members 4, shown illustratively as pairs of rollers, transport sheets 5 from supply 2 successively past an image forming or printing station 10 where a toned image is impressed on or otherwise transferred to the sheet, and a fixing station 20 where heat is applied to melt and fix the toned image so that it is both consolidated and well bonded to the sheet. The printing station 10 includes an imaging module 11 which forms a latent charge image on a dielectric member 12, and a toner section 13 which applies toner to the charged portions of member 12 to form a visible image. Toner section 13 includes a reservoir 13*a* and an applicator roll or brush 13*b*. The toned image is transferred to sheet 5 as the sheet passes between the member 12 and a transfer roller 14, so that at this intermediate stage a visible image has been printed on the sheet. This image has been only loosely transferred in the form of an unconsolidated toner powder image resting on the sheet surface. In this form the image is vulnerable to smudging and to dispersal by electrostatic forces.

In stage 20, heat is applied to fuse the powder image so that it is "fixed", i.e., bonded permanently to the sheet 5. While the application of heat may be effected by passing the sheet under a quartz heat lamp or between heated rollers, the present invention addresses constructions wherein the fusing energy is delivered as a short flash of illumination directed at the printed sheet. Such a "flash fuser" 20 includes one or more flash tubes 21 positioned by a reflector 22 and aimed at the transport path P of the sheet 5. The flash tube is typically a xenon flash tube which produces a pulse of bluish-white light of short duration, and which transfers its energy primarily to the toner particles to quickly raise their temperature and melt them onto, and wick the melted toner material into, the sheet 5.

Figure 2:
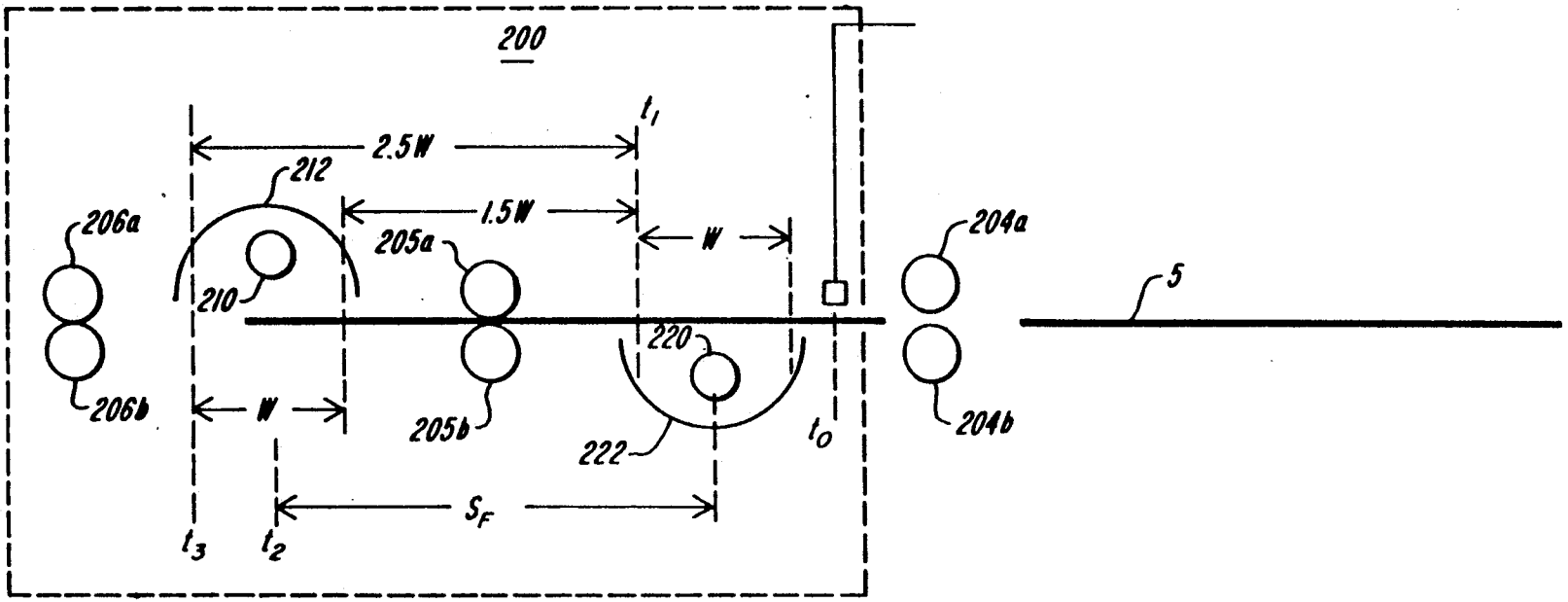
FIG. 2 is a schematic sectional view of one fusing and transport assembly according to the present invention.

The flash tube 21 is connected to a power supply 23 which is essentially an inductor in series with a capacitor bank charged to several hundred volts by a DC charging circuit. Flash tube 21 is triggered by a fifteen to twenty kilovolt trigger pulse from a trigger circuit 24. Several trigger pulses may be provided to fire the flash several times as sheet 5 is transported below the reflector 22, either to fuse successive portions of the image, or to bring the image up to the fusing temperature in several steps. It is understood that within this general architecture other conventional elements may be included, such as a low power heater to precondition the temperature of sheet 5, or a pair of pressure rollers at the output edge to more thoroughly fix the fused toner to the sheet FIG. 2 shows a flash fuser assembly 200 according to one aspect of the present invention, wherein a pair of flash units 210 and 220 are spaced apart along a sheet path P by a flash spacing $S_F$. Feed roller pairs 204*a*, 204*b*, 205*a*, 205*b* and 206*a*, 206*b* are spaced along the path P to move the sheet from a printing station past the fusing assembly 200. Reflective flash housings 212, 222 hold the respective flash tubes 210, 220 and are each directed facing toward the other on opposed sides of path P, so that each unit 210, 212 and 220, 222 illuminates a different side of a sheet 5 travelling along the path.

Each reflector and flash tube extends in a substantially homogeneous cross-sectional shape along an axis perpendicular to the plane of the drawing, and this axis corresponds to either the length or width direction of the sheet 5. For purposes of discussion, the direction of travel of sheet 5 shall be referred to as the length dimension herein. As discussed in greater detail with respect to FIGS. 6 et seq. below, the reflectors are shaped to provide a uniform level of flash illumination throughout an exposure "window" of width W along the length direction. In the illustrated embodiment, each flash unit 210, 220 comprises a single cylindrical flash tube centered in its reflective housing 212, 222. Furthermore, the reflectors have an aspect ratio, or ratio of height to width of roughly 2:3.

In accordance with one aspect of this invention, the opposed flash units are offset along the path P and the transport mechanism operates at different speed as the sheet 5 progresses past the units. In one prototype the reflectors were configured to expose a sixty millimeter length window W, and were triggered to provide a two millimeter overlap of successive exposures on each side of the sheet, so that five exposures covered the full length of an $A_4$ metric sheet.

Figure 3:
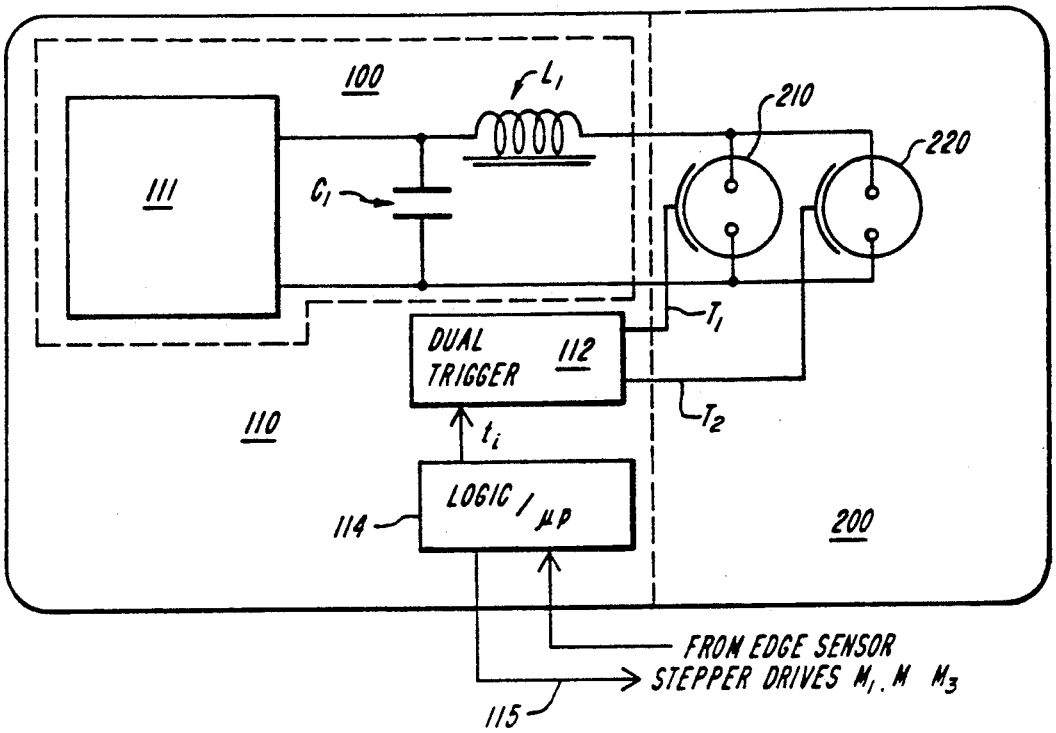
FIG. 3 shows the electrical connection of the fusing assembly of FIG. 2.

In this embodiment, the flash units 210, 220 are driven by a common electrical circuit 100 shown in FIG. 3, wherein a single energy unit 110 consisting of a DC charging circuit 111, capacitor $C_1$ and inductor $L_1$, is fixedly attached in parallel to both flash units 210, 220, and a dual output trigger circuit 112 operates under control of a microprocessor or dedicated logic module 114 to cause flash tube 210 or flash tube 220 to be fired by a trigger voltage applied along trigger line $T_1$, or $T_2$, respectively.

Applicant has found an effective level of light energy for flash fusing to be approximately one joule per square centimeter, so that assuming that the conversion of electrical energy to light energy has a fifty percent efficiency, and that the reflector has an eighty to ninety-five percent efficiency, the electrical input required to fuse a sheet of paper is slightly over two joules/cm$^2$ on each side of the sheet. Applicant has found that the peak power draw required to fire the flash tubes at a rate that both maintains sheet transport speed and covers the full page varies widely with flash tube spacing and flash timing.

Figure 4:
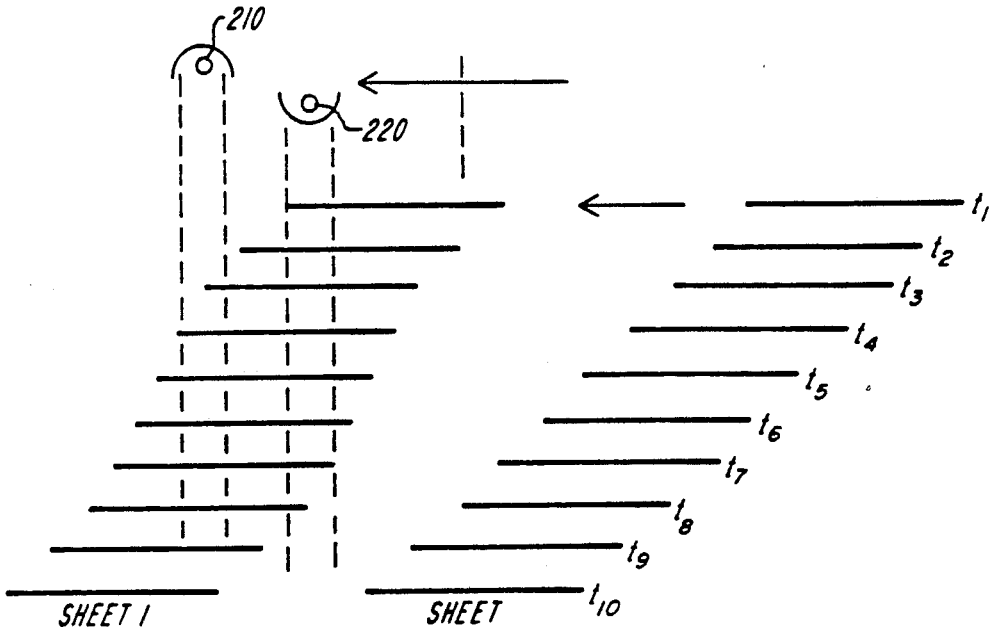
FIG. 4 illustrates timing and transport of the fusing assembly of FIG. 2.

In one embodiment of the invention configured for fusing a window of width W amounting to one-fifth of a page length with each flash, the flash units were spaced 2.5 W apart center-to-center, and the different feed roller pairs were driven at different speeds as the page was transported along the feed path P. The flash timing was controlled as set forth in the Table of FIG. 5, to flash at successive times $t_i$ as the sheet 5 progressed along the transport path P to the positions illustrated in FIG. 4. More generally, when the two flash tubes were spaced less than one page length apart, the sheet transport was controlled to move at a lower speed as the sheet traversed a central portion of the flash assembly.

Briefly, in the embodiment of FIG. 2, following an initial set of sheet movements in which one side is fused by one flash unit after each length of travel W, the sheet slows to half speed and both flashes are energized in alternating cycles as the sheet moves at half speed successive distances W/2. Once the first side (the bottom, as shown) has been fully exposed, the sheet transport resumes full speed and the other flash fires every interval W of sheet travel along the path to complete the fusing of the second side. After the final flash the sheet is ejected from the machine. At this point, the sheet may be accelerated to a faster than normal speed to synchronize with collation or paper handling functions at the output end of the printer. The flash thus is energized at times $t_i$, which are equi-spaced by time intervals $\delta t = W/S_N$ where $S_N$ is the normal, or initial, speed of sheet travel.

The three transport roller pairs are each preferably driven by independently-controlled rotational stepper motors, $M_1$, $M_2$, $M_3$ which receive control signals from the microprocessor/timing controller 114 along lines 115 (FIG. 3). These motor control signals are also indicative of position, and may be decoded or processed to provide trigger timing signals $t_i$ for controlling the flash.

With the above described flash and transport arrangement, the flash power supply draws a peak power consumption which is nearly equal to its average power consumption. It thus presents minimum machine power requirements in terms of external fuses and wiring, and also minimizes the capacity required of the relatively expensive charging circuit transformer, inductor and capacitor bank, to provide effective flash energy levels.

In addition, according to another aspect of the invention, the efficiency of fusing energy is enhanced by the reflectors 212, 222, which, as indicated above, are mirror finish reflectors that specularly reflect indirect illumination to provide uniform energy across the window W. FIG. 6A illustrates the operation of such a reflector. A flash tube F in reflector R emits light which directly reaches a point $P_1$ along a short path $d_1$ from the flash. The flash tube is cylindrically symmetrical and is generally modeled as a line source that emits light of equal intensity in all directions, so the energy reaching $P_1$ directly is proportional to $1/d_1$. The reflector is a mirror, i.e. a specular reflector, so it also reflects to $P_1$ that indirect illumination which was directed along a path $i_1$ at such an angle that the reflection path $i_1'$ strikes point $P_1$. The intensity of this indirect light is roughly proportional to $1/(i_1+i_1')$ times the reflector surface reflectance efficiency.

The problem of creating a uniform illumination window using a specular reflector R therefore entails making the reflector surface R follow a curve such that the power of indirectly reflected light reaching each point of the window plus the power of light reaching that point directly from the flash adds up to a constant level. Solution of this problem requires a model of flash tube light emission distribution which realistically approximates the actual flash tube output and allows the calculation of the reflected and direct power received by each region, which, as indicated above, must complement each other and add up to a uniform constant.

FIG. 6B illustrates the desired direct and reflected power curves for such a reflector.

The dashed graph $I_R$ indicates the intensity of light reflected by the reflector to each point of the window from the center out to an edge at distance W/2. The solid decreasing graph $I_D$ indicates the intensity of light reaching each point along a direct path from the flash tube. The reflector is designed such that $I_R+I_D$ totals to a substantially constant level C over the width of the exposure window In the course of designing a specular reflector to efficiently direct flash energy at a recording member, applicant has discovered that the flash tube is not accurately modeled as a radially-emitting line source, and that a reflector contour which is calculated using such a flash tube model results in hot spots and non-uniformities Applicant has solved this problem by observation of the emission characteristics of a cylindrical flash tube, and has found that by approximating the flash tube light output by a first component radially emitted from the central axis of the flash tube and a second component tangentially emitted at the periphery of the tube one may accurately calculate the distribution produced at the exposure window by a specular reflector. Applicant has further determined an optimal reflector contour by a process of selection of multiple curve segments, followed by a curve adjustment, to iteratively produce a reflector curve $C_R$ having the desired property of producing a light distribution at window W which complements the direct flash illumination.

Figure 7A:
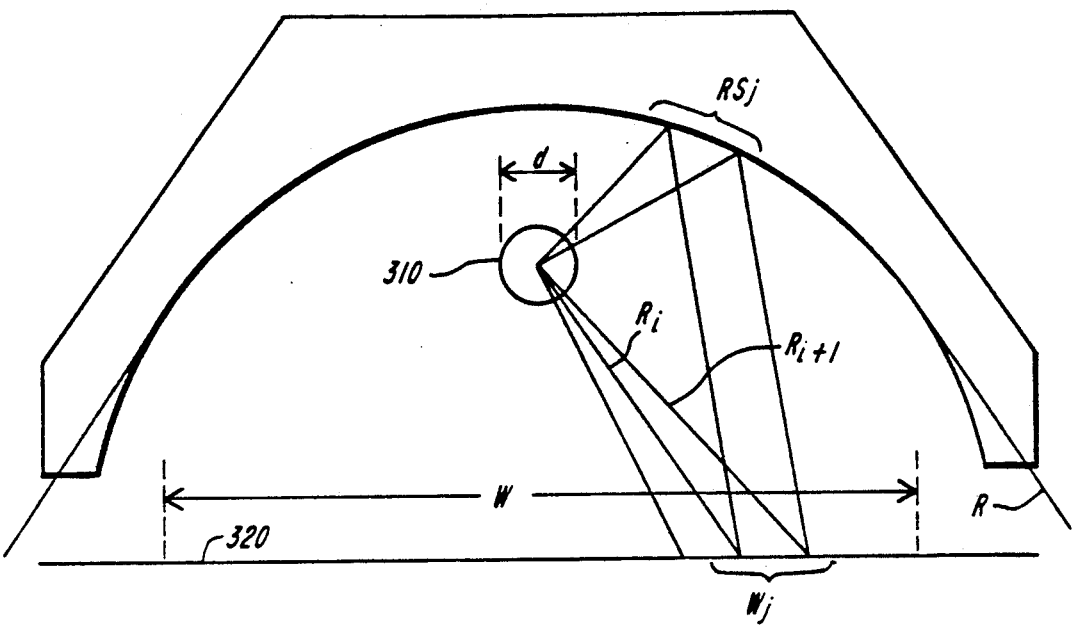
FIGS. 7A, 7B and 8A, 8B show steps of reflector curve determination.
Figure 7B:
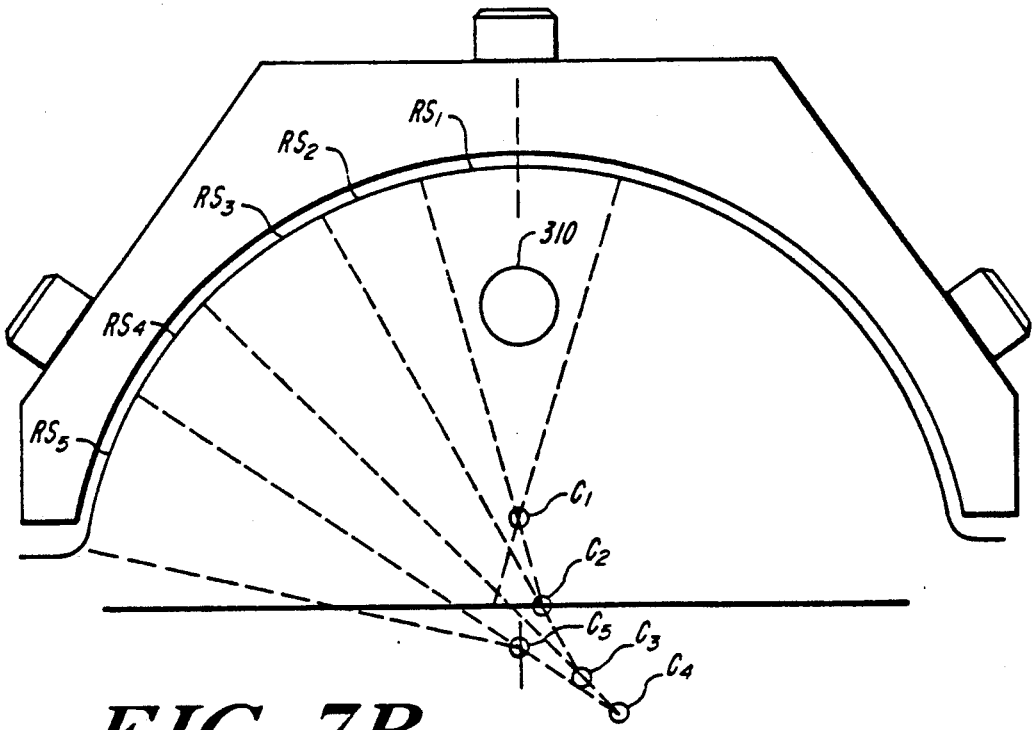

FIGS. 7A, 7B illustrate applicant's process of designing a specular reflection contour effective to provide a desired uniform exposure window 320 of width W for a flash tube 310 of uniform diameter d. The flash tube is linear, so a single cross-section is shown representative of each point along the tube axis, and the light distribution problem is essentially completely solved by solving the two-dimensional problem at one point along the axis.

The design proceeds from the selection of the basic window width W, which, by way of example, was selected to be sixty millimeters so that it would cover one-fifth of a standard $A_4$ or $B_4$ sheet with slight overlap. That is, the basic width W was selected to require five flashes per page to fix a toned image. Given this window, a reflector height of approximately two-thirds of the window width, or forty millimeters, was chosen to provide reasonably efficient reflection of light to the window while allowing adequate clearance of the flash tube trigger wire to prevent arcing. The flash tube itself was positioned at a height slightly above the midpoint between the reflector apex and the exposure window plane 320 of a parabolic reflector.

Next an initial modified profile was calculated as follows. The level of direct flash illumination across the window was calculated and the level of reflected light intensity $I_R(p)$ which would be required at each point p across the window was determined. Next, on the assumption that the flash tube emits light of equal intensity in all angular directions, equi-spaced radial rays $R_i$, corresponding to the rays $d_i$ of FIG. 6A, were drawn at five degree intervals and a succession of reflector curve segments $RS_j$ were calculated having curvatures and orientations effective to reflect the rays $R_i$ striking them onto successive areas $W_j$ of the window 320 such that each point p in $W_j$ received light of the desired compensating intensity $I_R(p)$. Briefly, the reflector segments were of cylindrical form, with differing radii of curvature which blended into a smooth contour somewhat steeper than the initial starting parabola shape.

FIG. 7A shows the initial parabolic reflector, and FIG. 7B shows the modified parabolic reflector obtained by using five successive cylindrical segments between the center and the outer edge of each side, oriented to reflect the radial rays onto successive bands of the window. In FIG. 7B, the central segment $RS_1$, and four successive segments $RS_2$–$RS_5$ forming the left side of the reflector are illustrated, with their corresponding centers of rotation $C_1$–$C_5$. A further set of segments and centers of curvature are symmetrically disposed about the mid-line and define the reflector right side.

Measurements of light at the window region 320 were made with the reflector of FIG. 7B, and these showed that the reflected light actually over-compensated the drop-off in direct illumination at the edges of the window by approximately twenty-five percent, so that a further reflector curve correction was desirable.

Figure 8A:
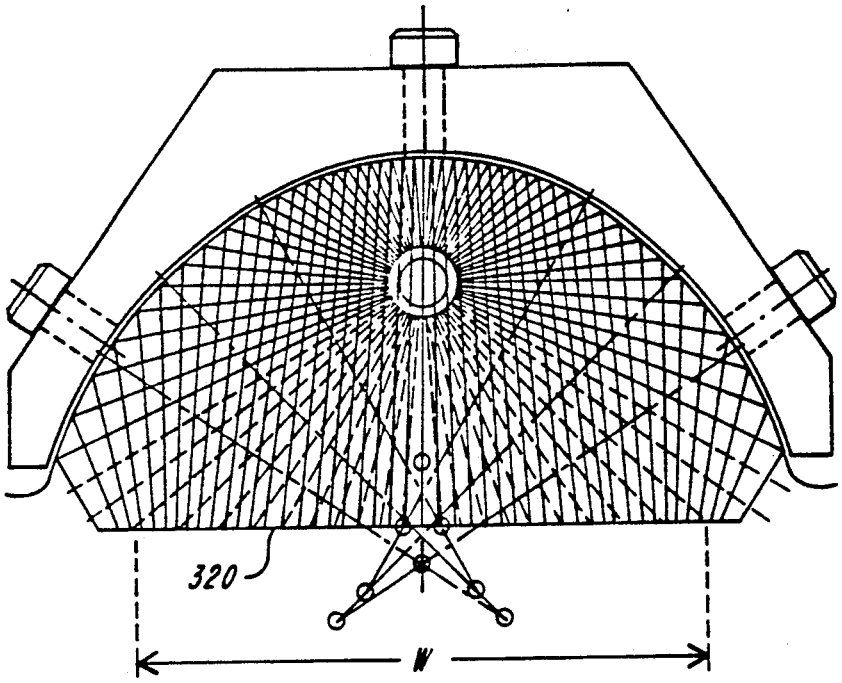
Figure 8B:
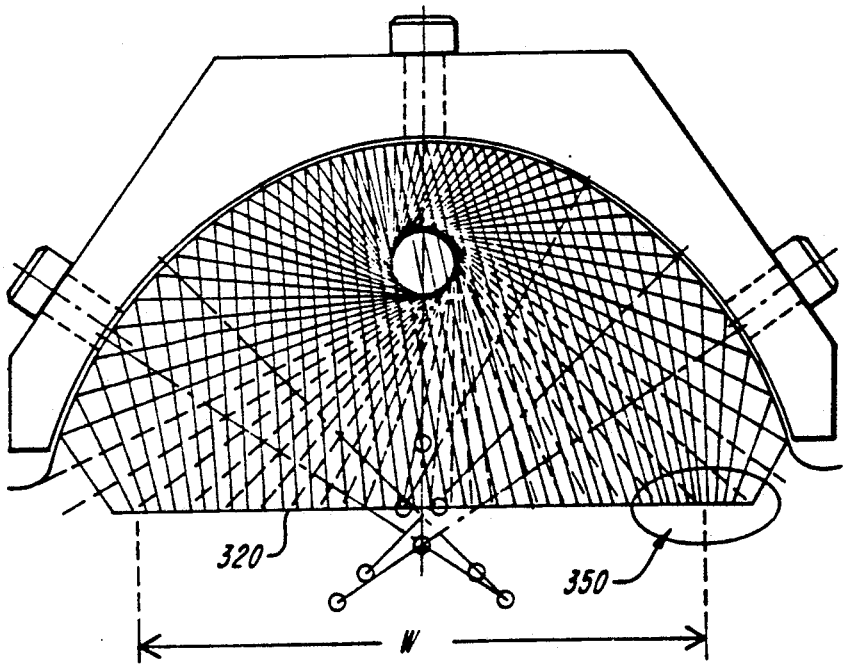

Applicant determined that this reflected "hot spot" or band of higher intensity on each side resulted from a flash tube emission distribution that differed from the hypothesized uniform radial emission. Specifically, applicant found that the light emission from the flash tube is more accurately modeled as consisting of radial rays emanating uniformly from the center plus a proportion of tangential rays emanating tangentially from the edge of the flash tube. FIGS. 8A, 8B illustrate the corresponding ray paths for the radial and tangential rays, respectively, striking the segmented reflector of FIG. 7B. Each successive radial ray in FIG. 8A, and tangential ray in FIG. 8B, is drawn at a uniform five degree interval, so that the distance between the successive rays at the exposure window is inversely proportional to the amount of light reflected to that area of the window. The circled region 350 at the edge of the exposure window indicates the high intensity region due to the excessive contribution of the tangential reflected rays in that area of window 320.

Figure 9A:
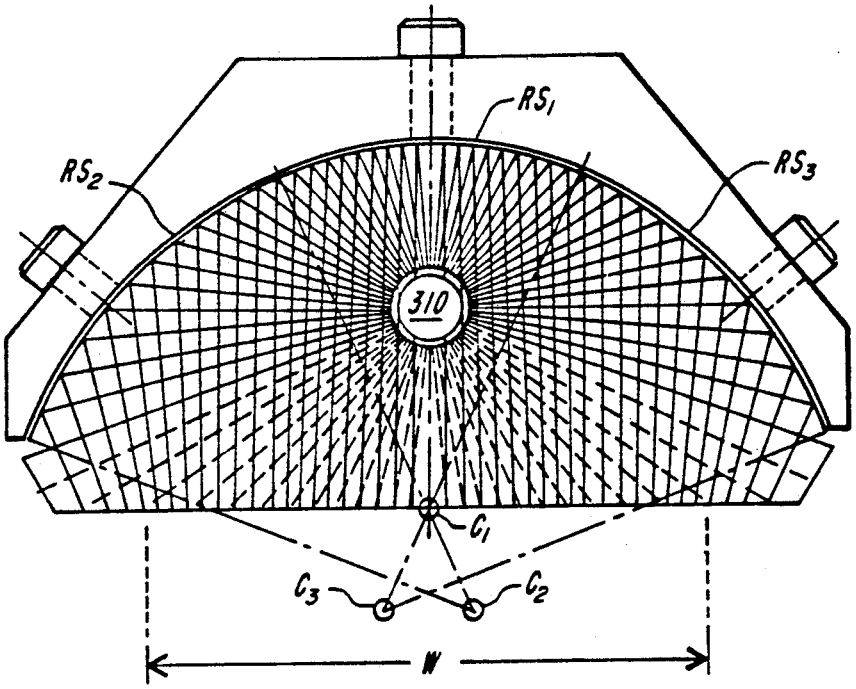
FIGS. 9A, 9B show a prototype reflector determined by the process illustrated in FIGS. 7 and 8.
Figure 9B:
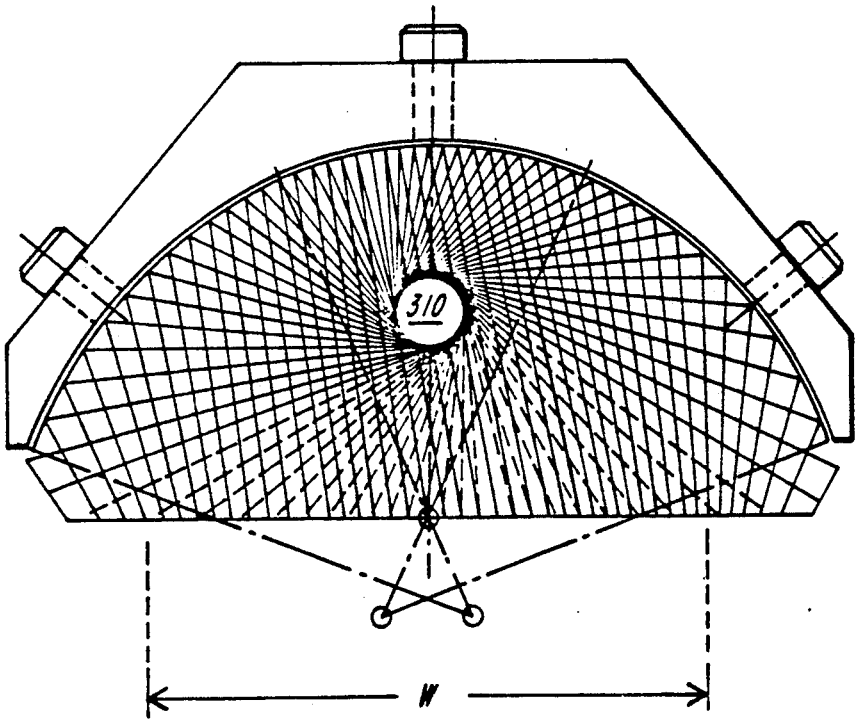

To remove the edge hot bands, in a second phase of reflector design, applicant made the edges of the reflector less steep to slightly broaden the total window area illuminated by the reflector while reducing the intensity of reflected light received by the edge regions FIGS. 9A, 9B show the final contour of the reflector with its edges corrected, which was implemented by three successive cylindrical segments smoothly joined together In this final step, the flash tube itself was slightly lowered from a height two-thirds that of the reflector apex to a position about eleven twentieths of the reflector height. A top cylindrical segment $RS_1$ of forty millimeters radius of curvature and spanning fifty degrees of arc with its center of curvature $C_1$ at the exposure plane was flanked by left and right cylindrical segments $RS_2$, $RS_3$ of fifty-two millimeters diameter, centered thirteen millimeters below the exposure plane at points $C_2$, $C_3$ each located five millimeters past the vertical center line. The two figures show the radial and tangential ray reflection paths.

The reflector constructed in the foregoing manner was found to provide effective fusing of toned images using an applied energy level approximately forty percent less than that required to achieve comparable fusing with a conventional integrating reflector.

In another embodiment of a specularly reflective flash reflector, the flash units were designed to each cover approximately one quarter of the page dimension along the axis of sheet feed. The two flash units were spaced 300 millimeters apart on centers, such that the first flash was actuated at four equi-spaced intervals to entirely fuse the first side of an $A_4$ sheet, and the second flash was then actuated to fuse the second side. With this flash spacing and actuation schedule, the sheet was fed through the flash fusing assembly at a uniform rate of speed. Similar efficiencies of energy utilization were noted.

Figure 10:
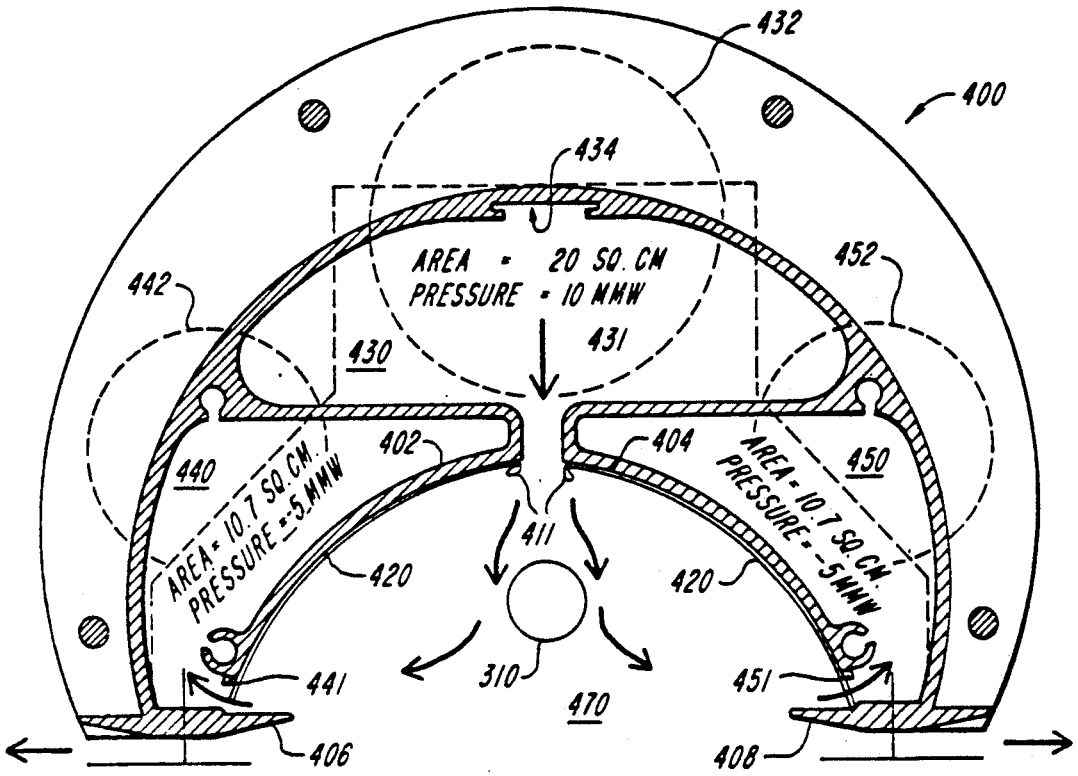
FIG. 10 is a detailed cross-section of the housing of one flash assembly in accordance with another aspect of the invention.

According to yet another aspect of this invention, the flash reflector may be implemented as a flexible reflective sheet which is removably replaceable and slidably insertable into a reflector housing. FIG. 10 illustrates such a housing 400, which is preferably implemented as an extruded member. As shown, the reflector chamber includes a support wall indicated generally by regions 402, 404, and at least one sill or ledge 406, 408. A reflective metal or metallized sheet comprised of one or more sections 420 is supported in a curved contour positioned by wall regions 402, 404, and is generally held in place under compression by pressure of its lower edges against the ledges 406, 408. In the illustrated embodiment, two sheets 420 are used. Each rests against a protruding rim 411 at its upper edge, and a sill 406 or 408 at its lower edge. The sheets may be snapped into place sideways, but for service or replacement are preferably installed and removed by simply sliding longitudinally along the axis of the housing, without disturbing the flash tube.

A suitable metal for element 420 may be a preanodized polished aluminum of 0.25 to 0.50 mm thickness, such as the aluminum 410-G of Ideal Metals, or the similar material sold under the trade name Alzac. When using the thicker 0.5 mm stock, the panels may be stamped to shape with the multi-segment curvatures as described above, while for the thinner 0.25 mm stock the reflector panels may be unworked, acquiring their curvature solely by being urged against the support surfaces 402, 404 of the housing 400. In that case, the surfaces 402, 404 have the desired curvature. The relatively wide lower protruding ledges 406, 408 allow the housing to properly accommodate sheet inserts of widths that vary widely, e.g., by approximately 0.1 to 0.3 millimeters, without impairing the reflector contour. This is because, when the sheets are held as illustrated, the extreme outer edges are the only portions having a contour affected by excessive variations in the sheet width, and these portions do not reflect any light to the window area.

According to yet a further aspect of the invention, the fuser assembly includes a housing defining a manifold with a plurality of passages which provide a controlled airflow past the flash tube and away from the reflector. In FIG. 10 these passages are formed as linear extrusion regions having the cross-sections 430, 440, and 450. Passage 430 extends centrally along the top of the housing and communicates via openings 431 with the reflector cavity 470 and flash tube 310, and in operation is fed at a slight positive pressure by a gas inlet 432, shown in phantom, so that a flow of cooling air is provided through the openings 431 directed at the flash tube. Passages 440, 450, on the other hand, extend along the sides of the housing and are each exhausted through openings illustrated in phantom by tube connections 442, 452. These lateral passages each communicate by symmetrically placed openings 441, 451, with the edges of the reflector cavity, causing the gas entering aperture 431 to follow generally along the flow lines indicated by arrows in the figure. In particular, the flow lines define below the reflector a barrier of flowing air which serves to pick up any dust or volatile materials released from the recording sheet and transport it out of the reflector cavity. This action reduces vapor and particulate contaminant and film build-up on the flash tube and the reflector surfaces.

In the illustrated embodiment, the pressurized passage 430 was designed to have a cross-sectional area of approximately twenty square centimeters and operate at a positive pressure of ten millimeters $H_2O$. The passages 440, 450 each had cross-sectional areas of 10.7 square centimeters and operated at a negative pressure of minus four millimeters $H_2O$, and were exhausted through a filter into the surrounding atmosphere. The inlet and outlet flows were substantially balanced to prevent turbulence at the paper transport region, and the reflector cavity 470 as a whole had a net positive pressure in the region between the opposite ledges 406, 408. This positive pressure served to flatten the recording sheet as it was transported past the exposure window, preventing its edges from curling up.

Thus the passages constitute a multi-purpose structure which defines a coolant flow for the flash tube, a fume-scavenging flow, and a paper-positioning pressure cushion.

In a preferred embodiment of this aspect of the invention, means are provided for directing the air flow to more effectively cool the relatively large amount of heat generated in the flash tube.

Figure 11:
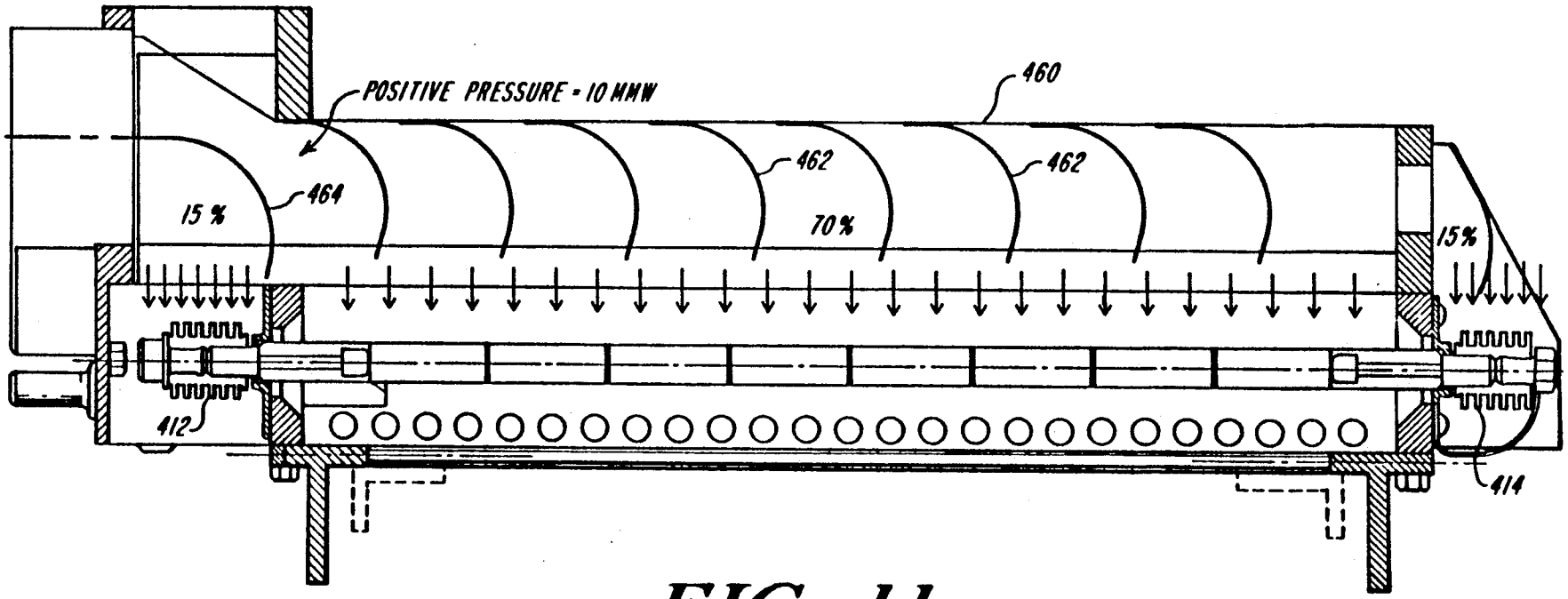
FIG. 11 is a vertical section through the housing of FIG. 10 illustrating details thereof.

FIG. 11 illustrates a vertical section of such preferred embodiment taken along the axis of the flash tube 310 and housing 400. An elongated member 460 having a plurality of extending vane elements or fingers 462 is mounted in the passage 430 of the reflector housing assembly (e.g., in slot 434, FIG. 10) such that the fingers redirect the axial airflow in passage 430 downwardly through the apertures 431 at the flash tube 310.

In forcing a relatively direct flow of air centrally at the flash tube, the air-directing fingers 462 assure good thermal transfer characteristics with the tube. Since the air striking the flash tube naturally tends to follow flow lines along the surface of the tube, the flow is effective to cool all sides of the tube. The fingers may be flat or convexly dished in the direction transverse to their long dimension. The member 460 with its plurality of extending vanes or fingers 462 may, for example, be formed as a molded plastic or a stamped metal member.

At each end of the flash tube additional deflecting vanes 463, 464 attached to the housing or its accessory covers serve to deflect a portion of the cooling air onto finned heat exchangers 412, 414 which enhance cooling of the flash tube electrode structure, thereby lengthening the lifetime of the tube as a whole. The sizes and lengths of the fingers 462, as well as their positioning end overlap with vanes 463, 464 are selected so that approximately seventy percent of the cooling air is directed into reflector cavity 470, while fifteen percent is directed at each flash tube end cap. The proportion may be varied for different flash tubes or more severe operating cycles.

This completes a description of a flash fuser device according to the invention and different aspects and representative embodiments thereof. Each aspect has been described for clarity of illustration by reference to a particular structure, mechanism or control system in order to illustrate in a concrete fashion the principles of operation, but the invention is not limited to the particular embodiments discussed herein. Rather, the invention comprehends within its scope such equivalents, variations and modifications as this disclosure suggests to persons skilled in the art, as defined by the claims appended hereto.

What is claimed is:

1. A flash assembly comprising a transport which moves an unfixed recording past an exposure window for exposure to flash illumination, a flash tube positioned over the exposure window to illuminate the recording with direct illumination comprising light travelling along direct ray paths from the flash tube to the recording as it is moved by the transport, and a specular reflector positioned about the flash tube, said reflector having a curvature effective to intercept and specularly reflect to the exposure window light exiting the flash tube that is not directed at the exposure window so as to complement the intensity of direct illumination from the tube with an amount of specularly reflected light effective to produce a substantially uniform level of illumination in the exposure window.

2. A flash assembly according to claim 1, wherein said reflector forms a curved surface over said window with a height to width aspect ratio of approximately 2:3.

3. A flash assembly according to claim 1, wherein said reflector has an approximately parabolic section wherein curvatures of regions of a parabola are progressively steepened to intensify the off center distribution of reflected light radially exiting the flash tube and flattened to diminish the edge intensity of reflected light tangentially exiting the flash tube.

4. A flash assembly according to claim 1, wherein said reflector comprises plural cylindrical segments of differing curvatures.

5. A flash assembly according to claim 4, wherein said plural cylindrical segments constitute a smooth curve.

6. A flash assembly according to claim 1, wherein said reflector includes a polished metallic sheet which extends in a housing parallel to said flash tube.

7. A flash assembly according to claim 6, wherein said polished metallic sheet is secured against the housing and assumes a curvature conforming thereto.

8. A flash fusing assembly comprising a linearly extending housing member having a substantially uniform section at each point along its length determined by walls defining a flash chamber, and a plurality of air conduits parallel to the flash chamber, said flash chamber positioning a flash tube therein over an exposure surface, said plurality of air conduits including a positive pressure air conduit opening above the flash tube and at least one negative pressure air conduit arranged laterally about said flash chamber to centrally direct air at said flash tube and thereafter draw a flow of air downwardly past the tube along a exposure surface to prevent soiling of reflective surfaces while cooling the flash tube.

9. The flash assembly of claim 8, wherein said positive pressure conduit is opposite said exposure surface, and a pair of said negative pressure conduits are adjacent to said flash tube.

10. The flash assembly of claim 9, wherein said positive and negative conduits are effective to provide a positive pressure in said flash chamber at said exposure surface for maintaining a sheet flat as it is transported past said exposure surface.

11. The flash assembly of claim 8, wherein said linearly extending housing is an extrusion.

12. The flash assembly of claim 8, wherein said flash chamber includes a slidably replaceable reflective sheet.

13. The flash assembly of claim 8, wherein said flash chamber includes a reflective surface having a contour effective to deliver a substantially uniform level of combined direct and specularly reflected light at said exposure surface.

14. A flash assembly comprising a housing and means for holding a flash tube in said housing oriented along a housing axis, said housing defining a reflector cavity about said flash tube with spaced apart support members at edges thereof, and at least one reflective sheet which removably fits into the housing along said axis and is positioned by said support members to reflect light from the flash tube into a flash exposure window.

15. The flash assembly of claim 14, wherein a said reflective sheet is a specularly reflective sheet.

16. The flash assembly of claim 15, wherein a said sheet is supported by said support members along a curvature to provide reflected light which complements direct light from the flash tube to result in a substantially uniform level of illumination over said window.

17. The flash assembly of claim 14, wherein the assembly includes two reflective sheets with an air vent opening therebetween.

18. The flash assembly of claim 14, wherein the housing is formed by extrusion.

19. The flash assembly of claim 14, wherein the housing includes positive and negative pressure manifolds defining air flow through the reflector cavity for simultaneously cooling the flash tube and scavenging fumes from the cavity.

20. A flash assembly comprising transport means for carrying a recording member along a transport path past an exposure region and for carrying the recording member at a reduced speed in a central portion of the exposure region, first and second oppositely-faced flash tubes mutually offset along said transport path by a distance less than one page length and directed at said exposure region to heat recordings on two opposite sides of said recording member as the member is transported, a power supply operatively connected to both said flash tubes, and actuation means for triggering each said flash tube at plural different times effective to heat the entire area of both sides of said recording member as it is moved through the exposure region.

21. The flash assembly of claim 20, wherein said actuation means triggers said first and said second flash tubes in alternation as said transport means carries the recording member past a central portion of said exposure region.

22. The flash assembly of claim 20, in combination with an electrographic print system wherein a single print engine successively prints both sides of the recording member to provide two-sided recording members at twice a sheet feed interval, and wherein the recording members pass without storage or backup directly to the transport means and through said flash assembly.

23. A flash assembly comprising transport means for carrying a recording member along a transport path past an exposure region, first and second oppositely-facing flash tubes mutually offset along said transport path and directed at said exposure region to heat recordings on two opposite sides of said recording member as the member is transported.

a power supply operatively connected to both said flash tubes, and actuation means for triggering each said flash tube at plural different times effective to heat the entire area of both sides of said recording member as it is moved through the exposure region, wherein said transport means includes means for transporting the recording member along a central portion of said exposure region at an average speed which is one half of its speed at an edge portion of said exposure region.

24. A flash assembly comprising transport means for carrying a recording member along a transport path past an exposure region, first and second oppositely-facing flash tubes mutually offset along said transport path and directed at said exposure region to heat recordings on two opposite sides of said recording member as the member is transported, a power supply operatively connected to both said flash tubes, and actuation means for triggering each said flash tube at plural different times effective to heat the entire area of both sides of said recording medium as it is moved through the exposure region, wherein each flash tube exposes a window of width W, and said tubes are offset by $$\frac{(2n+1)W}{2},$$

where n=(0, 1, 2, . . .).

25. A flash assembly comprising transport means for carrying a recording member along a transport path past an exposure region, first and second oppositely-facing flash tubes mutually offset along said transport path and directed at said exposure region to heat recordings on two opposite sides of said recording member as the member is transported, a power supply operatively connected to both said flash tubes, and actuation means for triggering each said flash tube at plural different times effective to heat the entire area of both sides of said recording member at it is moved through the exposure region, wherein the transport means includes first, second and third transport mechanisms which respectively transport the recording member at a first edge, a central region and an opposite edge of a transport path through said flash assembly.

26. A flash assembly comprising transport means for carrying a recording member along a transport path past an exposure region, first and second oppositely-facing flash tubes mutually offset along said transport path and directed at said exposure region to heat recordings on two opposite sides of said recording member as the member is transported.

a power supply operatively connected to both said flash tubes, and actuation means for triggering each said flash tube at plural different times effective to heat the entire area of both sides of said recording member as it is moved through the exposure region, wherein each flash tube is mounted in a reflective housing that defines a uniform exposure window W which is substantially (1/n) times the width of the recording member, and the two flash tubes are positioned a distance at least nW/2 apart.

27. The flash assembly of claim 26, wherein the actuation means triggers 2 n times to heat the entire area of both sides of the recording member.

28. A flash assembly comprising transport means for carrying a recording member along a transport path past an exposure region, first and second oppositely-facing flash tubes mutually offset along said transport path and directed at said exposure region to heat recordings on two opposite sides of said recording member as the member is transported, a power supply operatively connected to both said flash tubes, and actuation means for triggering each said flash tube at plural different times effective to heat the entire area of both sides of said recording member as it is moved through the exposure region, wherein said first and second flash tubes are spaced apart greater than one page length, and wherein said transport means carries said recording member at a uniform speed through the exposure region.

* * * * *

UNITED STATES PATENT AND TRADEMARK OFFICE

CERTIFICATE OF CORRECTION

PATENT NO. : 5,113,223

DATED : May 12, 1992

INVENTOR(S) : Sotos M. Theodoulou, Duncan Gibbons, Christopher W. Thomson and Hassan A. Khataan It is certified that error appears in the above-indentified patent and that said Letters Patent is hereby corrected as shown below:

At column 3, line 63 after "sheet", insert --.--.

At column 6, line 2 after "window", insert --.--.

At column 6, line 9 after "non-uniformities", insert --. --.

At column 7, line 41 after "together", insert --.--.

Signed and Sealed this

Sixteenth Day of January, 1996

Bruce Lehman

*Attest:*

BRUCE LEHMAN

*Attesting Officer*

*Commissioner of Patents and Trademarks*